US007492323B2

(12) United States Patent
Nielsen

(10) Patent No.: US 7,492,323 B2
(45) Date of Patent: Feb. 17, 2009

(54) ANTENNA ASSEMBLY AND A METHOD FOR SATELLITE TRACKING

(75) Inventor: Peter Nielsen, Hobro (DK)

(73) Assignee: Spacecom Holding APS, Hobro (DK)

( * ) Notice: Subject to any disclaimer, the term of this patent is extended or adjusted under 35 U.S.C. 154(b) by 50 days.

(21) Appl. No.: 11/718,558

(22) PCT Filed: Oct. 19, 2005

(86) PCT No.: PCT/DK2005/000672

§ 371 (c)(1),
(2), (4) Date: Jun. 12, 2007

(87) PCT Pub. No.: WO2006/048013

PCT Pub. Date: May 11, 2006

(65) Prior Publication Data

US 2007/0290936 A1 Dec. 20, 2007

Related U.S. Application Data

(60) Provisional application No. 60/624,953, filed on Nov. 4, 2004.

(51) Int. Cl.
*H01Q 3/00* (2006.01)

(52) U.S. Cl. ..... 343/757; 343/765; 343/766; 342/359

(58) Field of Classification Search ..... 343/757, 343/758, 765, 766, 781 CA, 840; 342/359
See application file for complete search history.

(56) References Cited

U.S. PATENT DOCUMENTS 4,579,035 A 4/1986 Whiting
4,910,527 A 3/1990 Dushane et al.
5,223,845 A * 6/1993 Eguchi ..... 342/359
5,398,035 A 3/1995 Densmore et al.
5,644,322 A 7/1997 Hayes
5,742,253 A 4/1998 Conroy et al.
5,751,247 A 5/1998 Nomoto et al.

(Continued)

FOREIGN PATENT DOCUMENTS

EP 0982797 3/2000

(Continued)

*Primary Examiner*—Tan Ho
(74) *Attorney, Agent, or Firm*—Gifford, Krass, Sprinkle, Anderson & Citkowski, P.C.

(57) ABSTRACT

The present invention relates to a method for satellite tracking by use of an antenna assembly having a master antenna for receiving and transmitting signals to and from a master antenna satellite in a first frequency band, and a slave antenna for receiving signals from a slave antenna satellite in a second satellite band, where the master and slave antennas have physical bore-sight axes which can be arranged at different directions in relation to each other. The method of the invention includes a master antenna search routine and a slave antenna search routine. The master antenna search routine comprises the steps of changing or switching a direction of reception of the master antenna, monitoring, during the changing or switching of direction of reception of the master antenna. The slave antenna search routine comprises the steps of arranging the direction of the physical bore-sight axis of the slave antenna at a first slave direction, where the first slave direction is at least partly based on the obtained direction of the physical bore-sight axis of the master antenna.

25 Claims, 6 Drawing Sheets

U.S. PATENT DOCUMENTS

| | | | | |
|---|---|---|---|---|
| 5,835,057 | A | 11/1998 | van Heyningen | |
| 6,043,788 | A * | 3/2000 | Seavey | 343/781 CA |
| 6,191,734 | B1 | 2/2001 | Park et al. | |
| 6,243,046 | B1 * | 6/2001 | Aoki | 343/765 |
| 6,281,839 | B1 | 8/2001 | Nielsen | |
| 6,339,707 | B1 | 1/2002 | Wainfan et al. | |
| 6,356,539 | B1 | 3/2002 | Zuliani et al. | |
| 6,522,865 | B1 | 2/2003 | Otten | |
| 6,697,028 | B1 | 2/2004 | Gothard et al. | |
| 6,741,841 | B1 | 5/2004 | Mitchell | |
| 6,999,036 | B2 * | 2/2006 | Stoyanov et al. | 343/765 |
| 2003/0179145 | A1 | 9/2003 | Kanzaki | |
| 2003/0214454 | A1 | 11/2003 | Quagliaro | |

FOREIGN PATENT DOCUMENTS

| | | |
|---|---|---|
| EP | 1150379 | 10/2001 |
| EP | 1414104 | 4/2004 |
| WO | WO 97/15092 | 4/1997 |

* cited by examiner

ANTENNA ASSEMBLY AND A METHOD FOR SATELLITE TRACKING

FIELD OF THE INVENTION

The present invention relates to an antenna assembly and a method for satellite tracking and, more particularly to an antenna assembly and a method wherein a master antenna is used for transmitting and receiving satellite signals to and from a satellite in a first frequency band, and wherein a slave antenna is used for receiving satellite signals from a satellite signal in a second frequency band. The first frequency band may be different to the second frequency band.

BACKGROUND OF THE INVENTION

In communication via satellite to and from a moving vehicle such as a ship or car a "mobile terminal" installed on the vehicle is required. Such a "mobile terminal" is usually composed of one part being installed on a vehicles platform which platform is in a fixed position relative to the vehicle. This platform will hereafter be designated "moving platform" and the part of the terminal that is installed on it is designated EME (external mounted equipment), see also FIG. 1*a* and FIG. 1*b*. The "mobile terminal" will also usually include one part being installed at some location near the terminal user e.g. in the wheelhouse on a ship, this part being designated the IME (internal mounted equipment). The IME typically includes handset, PC, modem, interface electronics, power supplies etc. although there is a tendency that more and more of the IME electronics is moved to the EME in order to reduce cost and complexity in both IME and EME.

Satellite communication is becoming more and more popular among mobile subscribers as technology is improved on terminals, satellites and land earth stations. Satellite communication is efficient in remote areas outside the coverage area for traditional land based communication media such as PSTN or cell-phones but lacks the ability to offer high information rates at a competitive low cost. Nowadays, with digital communication techniques being used in almost all communication-systems a good measure for information rate is the bit rate i.e. the amount of information bits transferred per second. Many of the very popular L-band satellite terminals offer a facility to communicate voice, which most often is a low bit rate data transfer, the price being acceptable but still relative high. Also many L-band terminals offer communication of data at a medium speed i.e. 64 kbit per second but at a very inconvenient price.

There is a dramatic increase in the need for true high-speed data transfer via a satellite, at least in the direction from land earth station (LES) via satellite to the "mobile terminal" (also often designated mobile earth station MES, consisting of the above-mentioned EME and IME units), which direction will hereafter be designated the "forward direction". Here, high-speed date typically means from a few hundred kilobit per second to several megabit per second. The opposite direction in which data is being transferred from the MES via satellite to a LES will be designated the "return direction". When we say "data being transferred to the MES via a satellite in the forward direction", we mean data being modulated onto a suitable radio frequency carrier by the LES. This radio frequency carrier is transmitted to a satellite by the LES, which satellite typically is converting the received modulated carrier to a different modulated carrier, which modulated carrier will be given a large amplification and transmitted to the MES. When we say "data being transferred to the LES via a satellite in the "return direction", we mean data being modulated onto a suitable radio frequency carrier by the MES. This modulated radio frequency carrier is transmitted to a satellite by the MES, which satellite typically is converting the received modulated carrier to a different modulated carrier, which modulated carrier will be given a large amplification and transmitted to the LES. Preferably the above described "high speed data transfer" is utilized also in the "return direction", but very often a much lower data transfer capability is acceptable.

A data transfer via satellite requires a certain amount of radio frequency bandwidth, the higher the data rate the higher the required bandwidth. In the L-band, the available bandwidth is very limited for which reason bandwidth as a "resource" is very expensive. The L-band is often used for very reliable low to medium speed data rate transfers. The MES equipment and in particular the EME part designed to operate in this band is relative simple and low cost. Global coverage is often seen for L-band systems such as Inmarsat. In the higher frequency bands, such as S, X and K band, bandwidth is more readily available at a reasonable price, but complexity and hence cost of MES equipment, especially for the EME, goes up. Furthermore, global coverage is almost never seen, and coverage is most often limited to a region of the size of e.g. Europe or less.

In U.S. Pat. No. 5,835,057 a satellite communication system is described, in which an antenna assembly is used for receiving Ku-band signals from a first satellite by means of a Ku-band antenna and for transmitting and receiving L-band signals to and from a second satellite by means of a L-band antenna. However, this system is designed to operate in a special case, where the bore-sight axes of the Ku-band antenna and the L-band antenna can be identical, which is the case for the system described in U.S. Pat. No. 5,835,057. This special situation of two or more satellites having the same line of sight from the antennas is the case in North America with at least one of two AMSC satellites and a possible existing Ku-band satellite. The present AMSC system operates via two L-band satellites with about 5 degrees difference in orbital position. However, the system described in U.S. Pat. No. 5,835,057 does not enable simultaneous reception and transmission via two or more satellites, whose difference in orbital angle is much larger than 5 degrees.

Thus, there is a need for an antenna system, which enables simultaneous reception and transmission via two or more satellites, whose difference in orbital angles may vary to an extent, which will not allow for identical bore-sight axes of antennas communicating with different satellites.

SUMMARY OF THE INVENTION

According to the present invention there is provided an antenna assembly for satellite tracking, said antenna assembly comprising: a master antenna for receiving and transmitting first satellite signals to and from a master antenna satellite in a first frequency band, a slave antenna for receiving second satellite signals from a slave antenna satellite in a second satellite band, a master drive assembly for mechanically changing the direction of a physical bore-sight axis of the master antenna, and a slave drive assembly for mechanically changing the direction of a physical bore-sight axis of the slave antenna. Here, the master and slave assemblies is adapted for arranging the physical bore-sight axes of the master antenna and the slave antenna at different directions in relation to each other in response to one or more master-slave control signals.

Here, the slave antenna may further be adapted for transmitting second satellite signals to the slave antenna satellite in the second satellite band.

It is preferred that the master antenna is movably secured to the master drive assembly, and the slave antenna is movably secured to the slave drive assembly. It is also preferred that the master drive assembly is rigidly fixed in relation to the slave antenna.

According to an embodiment of the invention, the antenna assembly may further comprise master antenna switching means for changing or switching a direction of reception of the master antenna. Here, the master antenna switching means may be adapted for performing a mechanically changing or switching of the direction of the physical bore-sight axis of the master antenna, and the master antenna switching means may also or alternatively be adapted for performing an electrically changing or switching of the direction of reception of the master antenna, which electrically changing or switching may follow the mechanically changing or switching. It is preferred that the master antenna switching means is adapted for performing the electrically changing or switching of the direction of reception of the master antenna by use of beam switching or beam squint technology.

According to a preferred embodiment of the invention, the master antenna may be an array antenna.

According to an embodiment of the invention, the antenna assembly may further comprise monitor means for monitoring, during the changing or switching of direction of reception of the master antenna, one or more signals carrying information representing variations in receiving signal strength of one or more signals transmitted from the master antenna satellite. The antenna assembly may further comprise control means for providing one or more master control signals to the master drive assembly and/or the slave drive assembly to thereby control the movement of the master antenna in response to the results of the monitoring of the signal strength information signal(s) corresponding to the signal(s) from the master antenna satellite, thereby changing the direction of the physical bore-sight axis of the master antenna so as to reduce pointing errors of the master antenna in relation to the master antenna satellite.

It is also within an embodiment of the present invention that the antenna assembly further may comprise control means for providing the one or more master-slave controls signals to the master drive assembly and/or the slave drive assembly to thereby control the arrangement of the direction of the physical bore-sight axis of the slave antenna by using the direction of the physical bore-sight axis of the master antenna as a reference in azimuth.

The present invention also covers on or more embodiments of an antenna assembly, which further may comprise control means for providing the one or more master-slave controls signals to the master drive assembly and/or the slave drive assembly to thereby control the arrangement of the direction of the physical bore-sight axis of the slave antenna in relation to the physical bore-sight axis of the master antenna so that the angular distance in azimuth between said physical bore-sight axes is set at a given azimuth value, ALPHA(AZ). Preferably, the control means for providing the one or more master-slave controls signals to the master drive assembly and/or the slave drive assembly may further be adapted for providing control signals to thereby control the arrangement of the direction of the physical bore-sight axis of the slave antenna so that the angular distance in elevation between the physical bore-sight axis of the slave antenna and the horizontal plane is set at a given elevation value, ALPHA(ELS).

According to one or more embodiments of the invention, the antenna assembly may further comprise slave antenna switching means for changing or switching a direction of reception of the slave antenna. Here, the slave antenna switching means may be adapted for performing a mechanically changing or switching of the direction of the physical bore-sight axis of the slave antenna. The slave antenna switching means may be adapted for performing the mechanically changing or switching of the direction of the physical bore-sight axis of the slave antenna as a so-called step track switching. The slave antenna switching means may also or alternatively be adapted for performing an electrically changing or switching of the direction of reception of the slave antenna, which electrically changing or switching may follow the mechanically changing or switching. It is preferred that the slave antenna switching means is adapted for performing the electrically changing or switching of the direction of reception of the slave antenna by use of beam switching or beam squint technology.

It is within a preferred embodiment that the antenna assembly of the present invention further may comprise monitor means for monitoring, during the changing or switching of direction of reception of the slave antenna, one or more signals carrying information representing variations in receiving signal strength of one or more signals transmitted from the slave antenna satellite. Here, the antenna assembly may further comprise control means for providing one or more slave control signals to the slave drive assembly and/or the master drive assembly to thereby control the movement of the slave antenna in response to the results of the monitoring of the signal strength information signal(s) corresponding to the signal(s) from the slave antenna satellite, thereby changing the direction of the physical bore-sight axis of the slave antenna so as to reduce pointing errors of the slave antenna in relation to the slave antenna satellite.

For embodiments where the master drive assembly is rigidly fixed in relation to the slave antenna, the antenna assembly may further comprise one or more control systems being adapted for providing control signals to the master and slave drive assemblies in order to lock the physical bore-sight axes of the master antenna and the slave antenna in the same vertical plane, whereby when mechanically moving the master antenna to change the direction in azimuth of the physical bore-sight axis of the master antenna, the direction of the physical bore-sight axis of the slave antenna is mechanically changed to the same degree in azimuth.

The present invention also covers one or more embodiments, wherein the slave drive assembly is adapted for rotating or turning the physical bore-sight axis of the slave antenna in the azimuth direction by use of a slave azimuth axis, and for rotating or turning the physical bore-sight axis of the slave antenna in the elevation direction by use of a first slave elevation axis. The slave drive assembly may further be adapted to maintain the first slave elevation axis in a substantial horizontal position by rotating the first slave elevation axis by use of a second slave elevation axis arranged perpendicular to the first slave elevation axis, said second slave elevation axis being a slave cross elevation axis. It is also within an embodiment of the present invention that the master drive assembly may be adapted for rotating or turning the physical bore-sight axis of the master antenna in the azimuth direction by use of a master azimuth axis, and for rotating or turning the physical bore-sight axis of the master antennae in the elevation direction by use of a first master elevation axis. The master drive assembly may further be adapted to maintain the master azimuth axis in a substantial vertical position by rotating the master azimuth axis by use of a second master elevation axis arranged perpendicular to the first master elevation axis, said second master elevation axis being a master counter elevation axis. The antenna assembly according to an embodiment of the invention may further comprise a censor system adapted to provide control signals to the slave drive assembly in order to control rotating about the second slave elevation axis to thereby maintain the first slave elevation axis in a substantially horizontal position during a movement of the antenna assembly. Preferably, the censor system may further be adapted to provide one or more control signals to the master drive assembly in order to control rotating about the second master elevation axis to thereby maintain the first master azimuth axis in a substantial vertical position during a movement of the antenna assembly.

It is within an embodiment of the invention that the slave antenna may comprise a main reflector for reflecting said slave antenna satellite signals and a feed unit for receiving the reflected slave antenna satellite signals. Here, the slave antenna may be of the Cassegrain type having a sub-reflector arranged substantially inside the focus of the main reflector, and having the feed unit arranged substantially at the surface of the main reflector. The master drive assembly may be arranged at least partly at a blind spot of the slave antenna in front of the sub-reflector.

It is preferred that the second satellite signals in the second frequency band are transmitted in the X or K band. It is also preferred that the first satellite signals in the first frequency band are transmitted in the L or S band.

It should be understood that the antenna assembly of the present invention also covers one or more embodiments having a plurality of slave antennas for receiving and/or transmitting satellite signals from and/or to corresponding slave antenna satellites in corresponding slave satellite bands.

According to the present invention, there is also provided a method for satellite tracking by use of an antenna assembly having a master antenna for receiving and transmitting first satellite signals to and from a master antenna satellite in a first frequency band, and a slave antenna for receiving second satellite signals from a slave antenna satellite in a second satellite band, said master and slave antennas having physical bore-sight axes which can be arranged at different directions in relation to each other, said method including:

a) a master antenna search routine comprising the steps of:

changing or switching a direction of reception of the master antenna, monitoring, during the changing or switching of direction of reception of the master antenna, one or more signals carrying information representing variations in receiving signal strength of one or more signals transmitted from the master antenna satellite, and mechanically moving the master antenna in response to the results of the monitoring of the signal strength information signal(s) corresponding to the signal(s) from the master antenna satellite, thereby obtaining a direction of the physical bore-sight axis of the master antenna resulting in reduced pointing errors of the master antenna in relation to the master antenna satellite; and b) a slave antenna search routine comprising the steps of:

arranging the direction of the physical bore-sight axis of the slave antenna at a first slave direction, said first slave direction being at least partly based on the obtained direction of the physical bore-sight axis of the master antenna.

According to an embodiment of the method of the invention then, after the arrangement of the physical bore-sight axis of the slave antenna at the first slave direction, the slave antenna search routine may further comprise:

changing or switching a direction of reception of the slave antenna, monitoring, during the changing or switching of direction of reception of the slave antenna, one or more signals carrying information representing variations in receiving signal strength of one or more signals transmitted from the slave antenna satellite, and mechanically moving the slave antenna in response to the results of the monitoring of the signal strength information signal(s) corresponding to the signal(s) from the slave antenna satellite, thereby changing the direction of a physical bore-sight axis of the slave antenna so as to reduce pointing errors of the slave antenna in relation to the slave antenna satellite.

According to an embodiment of the method of the invention, the arrangement of the physical bore-sight axis of the slave antenna at the first slave direction may further be based on the orbital position of the master antenna satellite, the orbital position of the slave antenna satellite, and the geographical position of the antenna assembly.

The method of the invention also covers one or more embodiments, wherein the obtained direction of the physical bore-sight axis of the master antenna is used as a reference in azimuth for the arrangement of the direction of the physical bore-sight axis of the slave antenna at the first slave direction.

It is preferred that the arrangement of the direction of the physical bore-sight axis of the slave antenna at the first slave direction comprises the step of arranging the angular distance in azimuth between the physical bore-sight axes of the master antenna and the slave antenna at a given azimuth value, ALPHA(AZ). It is also preferred that the arrangement of the direction of the physical bore-sight axis of the slave antenna at the first slave direction comprises the step of arranging the angular distance in elevation between the physical bore-sight axis of the slave antenna and the horizontal plane at a given elevation value, ALPHA(ELS). The given azimuth value and/or the given elevation value may preferably be determined from the obtained direction of the physical bore-sight axis of the master antenna, the orbital position of the master antenna satellite, the orbital position of the slave antenna satellite, and the geographical position of the antenna assembly.

The method(s) of the invention may further include an initial setting routine being performed before the master antenna search routine, wherein initial setting routine may comprise locking the physical bore-sight axes of the master antenna and the slave antenna in the same vertical plane, whereby when mechanically moving the master antenna to change the direction in azimuth of the physical bore-sight axis of the master antenna, the direction of the physical bore-sight axis of the slave antenna is mechanically changed to the same degree in azimuth, said locking being maintained during the master search routine. Here, the initial setting routine may comprise arranging and maintaining the physical bore-sight axis of the slave antenna at a substantially horizontal position. The initial setting routine may further comprise arranging and maintaining the physical bore-sight axis of the master antenna at a substantially horizontal position.

It is within one or more embodiments of the method(s) of the invention that the changing or switching of the direction of reception of the master antenna in the master antenna search routine comprises a mechanically changing or switching of the direction of the physical bore-sight axis of the master antenna. The changing or switching of the direction of reception of the master antenna in the master antenna search routine may also or alternatively comprise an electrically changing or switching of the direction of reception of the master antenna. The electrically changing or switching may follow the mechanically changing or switching. It is preferred that the electrically changing or switching of the direction of reception of the master antenna is initiated when one or more signals transmitted from the master antenna satellite are received by a given signal strength. The master antenna may be an array antenna and the electrically changing or switching of the direction of reception of the master antenna may be performed using beam switching or beam squint technology.

It is within one or more embodiments of the invention that the changing or switching of the direction of reception of the slave antenna in the slave antenna search routine comprises a mechanically changing or switching of the direction of the physical bore-sight axis of the slave antenna. Here, the mechanically changing or switching of the direction of the physical bore-sight axis of the slave antenna may be performed as a so-called step track switching. The changing or switching of the direction of reception of the slave antenna in the slave antenna search routine may also or alternatively comprise an electrically changing or switching of the direction of reception of the slave antenna. The electrically changing or switching may follow the mechanically changing or switching. It is preferred that the electrically changing or switching of the direction of reception of the slave antenna is initiated when one or more signals transmitted from the slave antenna satellite are received by a given signal strength. The electrically changing or switching of the direction of reception of the slave antenna may be performed using beam switching or beam squint technology.

Also for the method(s) of the invention it is preferred that the slave antenna comprises a main reflector for reflecting said slave antenna satellite signals and a feed unit for receiving the reflected slave antenna satellite signals. Here, the slave antenna may be of the Cassegrain type having a sub-reflector arranged substantially inside the focus of the main reflector, and having the feed unit arranged substantially at the surface of the main reflector. Preferably, the master antenna is movably secured to a master drive assembly being arranged at least partly at a blind spot of the slave antenna in front of the sub-reflector.

Also for the method(s) of the invention it is preferred that the second satellite signals in the second frequency band are transmitted in the X or K band. It is also preferred that the first satellite signals in the first frequency band are transmitted in the L or S band.

It should be understood that according to the present invention there is provided a method and an antenna assembly, which may be used for communication of multi-beam multi-frequency electromagnetic signals, and which may provide a solution for simultaneously stabilizing two or more antennas with the purpose to simultaneously track two or more completely independent electromagnetic energy sources being used for the communication of electromagnetic signals. For the present invention communication of multi-beam multi-frequency electromagnetic signals may be both ways i.e. to and from all antennas or only one way for at least one of the antennas. A typical example of an electromagnetic energy source is a satellite with the ability to transmit a radio signal in the direction of the position of the said antennas.

According to an embodiment of the present invention there may be provided a hybrid antenna system or antenna assembly (hybrid EME), which offers to the mobile satellite communication market, and in particular the maritime market, an antenna system or antenna assembly (hybrid EME) that enables simultaneous two way or only one way communication at two or more frequencies in two or more frequency bands, which may enable the subscriber to select among services and improve the ability to achieve lower cost for data transfer. For example, one communication link both in forward and return direction may be established in the L-band, while simultaneously a dependant or independent communication link may be established in a different frequency band e.g. the K-band, which K-band link may have both forward and return link or only forward link. The e.g. L-band communication link may be via any L-band satellite in the hemisphere as seen from the location of the hybrid EME, and the e.g. K-band communication link may be via any K-band satellite in the hemisphere that is seen from the same hybrid EME, where the hybrid EME may be a suitable combination of a e.g. L-band antenna and K-band antenna. The hybrid antenna system may preferably be low cost and hence preferably accommodated in one single dome. Since all antennas (typically two) in the hybrid antenna system may be tracking simultaneously on the respective satellites, it is within an embodiment of the present invention that the tracking mechanism(s) is constructed in a way so that they utilize available information from each other. In particular if e.g. one antenna is tracking on a L-band satellite (which tracking by nature is relative simple, very robust but with limited accuracy), information from this L-band tracking system can very beneficially be utilized as a coarse (but probably not sufficient accurate) tracking means for a e.g. high gain K-band antenna, where the L-band antenna and the K-band antennas may be build together in a very cost reducing manner.

A further advantage of the present invention is that a hybrid antenna system or antenna assembly according to the present invention may not require information from external devices such as a ship, gyrocompass or any other type of compass or sensor. This feature may enable a simple and quick installation on e.g. a ship, with the result that installation costs may be kept at a minimum. Further the entire hybrid EME may be accommodated in a single dome and require preferably (but not limited to) only one single coaxial cable as the physical interface between EME and IME.

The invention will now be described in further details with reference to the accompanying drawings.

DETAILED DESCRIPTION OF THE INVENTION

Figure 1A:
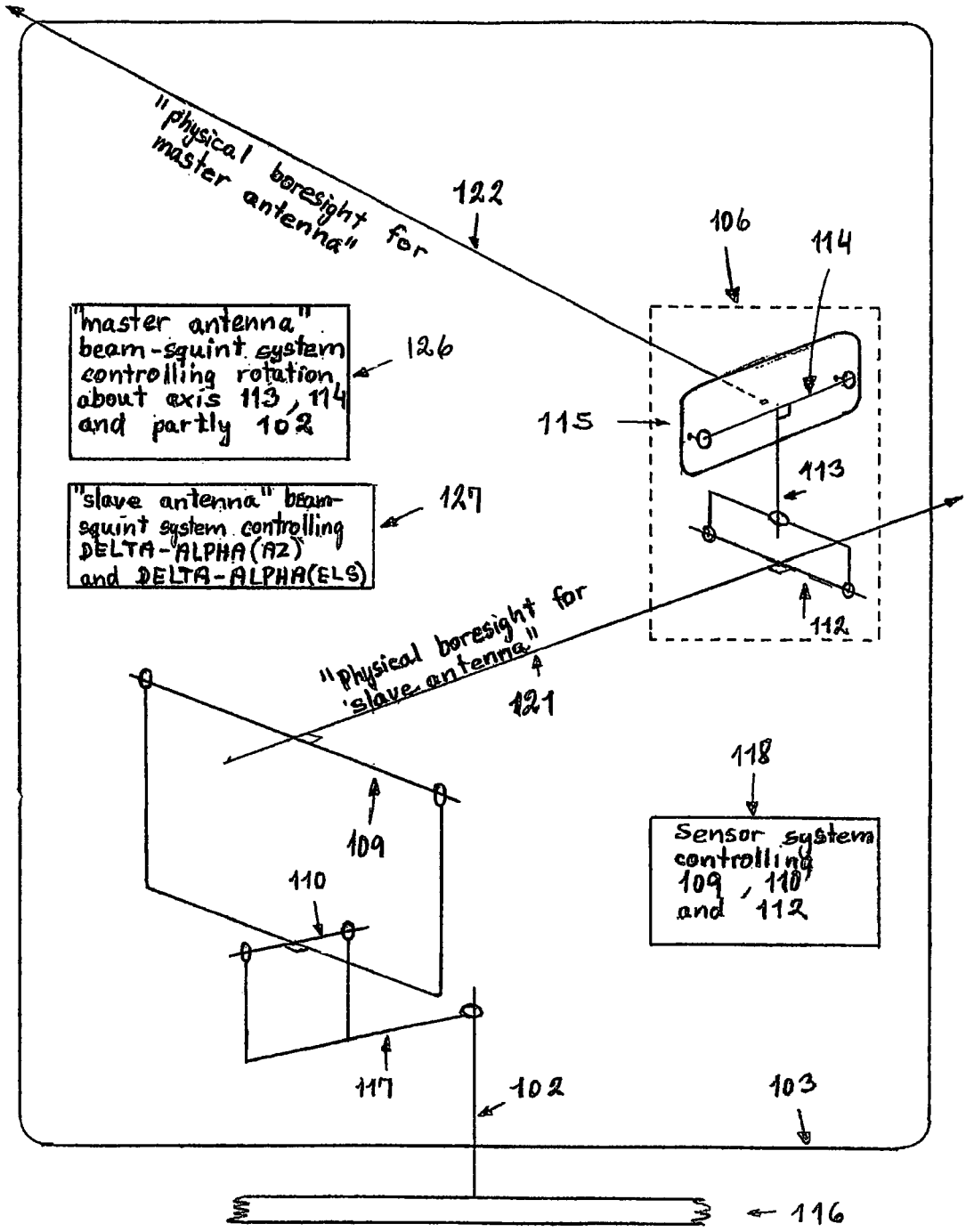
FIG. 1*a* shows the principles of a first embodiment of a system according to the present invention.

In Table 1 is given a list of designations and reference numerals used in FIG. 1*a*, FIG. 1*b*, FIG. 1*c*, FIG. 1*d*, FIG. 1*e* and FIG. 1*f*.

TABLE 1

| List of designations | |
|---|---|
| 101: | "azimuth I motor"; |
| 102: | "azimuth I axis"; |
| 103: | dome, which accommodates the entire EME (external mount equipment); |
| 104: | shaped (typically hyperbolic) sub-reflector for "slave antenna"; |
| 105: | shaped (typically parabolic) main reflector for "slave antenna"; |
| 106: | dome for "master antenna"; |
| 107: | feed arrangement for "slave antenna"; |
| 108: | front-end for "slave antenna"; |
| 109: | "elevation I axis"; |
| 110: | "cross-elevation axis"; |
| 111: | supporting structure for "slave antenna", sub-reflector and complete "master antenna" mechanical structure including 106; |
| 112: | "counter elevation axis" for "master antenna"; |
| 113: | "azimuth II axis" for "master antenna"; |
| 114: | "elevation II axis" for "master antenna"; |
| 115: | antenna element for "master antenna"; |
| 116: | "moving platform" (part of vehicle body e.g. a mast on a ship); |
| 117: | supporting arm; |
| 118: | dual axis sensor system with gravity as a reference; |
| 119: | "cross elevation motor"; |
| 120: | "elevation I motor"; |
| 121: | "physical bore sight axis for slave antenna"; |
| 121A: | "physical bore sight axis for slave antenna" when this is in the "initial setting"; |
| 122: | "physical bore sight axis for master antenna"; |
| 122A: | "physical bore sight axis for master antenna" when this is in the "initial setting"; |
| 123: | "motor for counter elevation axis" for "master antenna"; |
| 124: | "motor for azimuth II axis" for "master antenna"; |
| 125: | "motor for elevation II axis" for "master antenna"; |
| 126: | "master antenna" beam-squint system controlling rotation about axis 113, 114 and partly 102; |
| 127: | "slave antenna" beam-squint system controlling DELTA-ALPHA(AZ) and DELTA-ALPHA(ELS); and |
| 128: | a projection of 122 onto the horizontal plane. |

It shall be understood that the basic principles of the present invention as described in the appending claims can be realized in many other ways than that shown and illustrated in FIGS. 1*a*-1*f*. The realization shown in FIG. 1*a* through FIG. 1*f* will, however, constitute a very beneficial design and solution for the problems of stabilizing high gain antennas on a small ship in rough sea. Other solutions and specially solutions involving less complicated mechanics may be utilized in less demanding applications such as "mobile terminals" operating in small regional areas of the earth and/or exposed to only very limited ships motion (vehicle motion).

The system of the present invention may be an electromechanical system, more specific the EME of a "mobile terminal". The EME is meant to be installed on a suitable platform (called a "moving platform") of a vehicle such as a ship or car but preferably on a ship and may be designed to offer reliable multi channel transmission to and from the vehicle even when this is exposed to motions such as roll, pitch, yaw and turn characterized by high amplitude such that occur on a ship in rough sea. The system may enable reliable multi channel transmission by offering stabilization of a plurality of antennas preferably two, each antenna performing a satellite tracking function, which may be independent of the other(s), but in such a way that one antenna (typically the smaller antenna operating in the lower frequency band) is performing a "master antenna" function that may establish a rough but still very accurate reference for the other(s) hereafter called the "slave antenna(s)". This reference may provide a narrow "window" in terms of azimuth angle inside which the slave antenna(s) can perform its own sufficient accurate tracking once it has been given an offset angle ALPHA(AZ) relative to the master antenna. As the mobile terminal moves over the surface of the earth this offset angle will change. Means may be provided to periodically update and optimise ALPHA(AZ).

In a preferred embodiment of the present invention an electromechanical system perform stabilization of a low to medium gain "master antenna", the purpose of which is to enable reception and transmission to and from a satellite operation in an appropriate frequency band, e.g. L-band, with the purpose to communicate information, e.g. voice and low speed data, at a relative higher cost. The satellite tracked by the "master antenna" is called "master antenna satellite" for convenience. Further, in a preferred embodiment of this invention, an electromechanical system perform stabilization of a high gain "slave antenna" with stringent requirements to pointing error. The purpose of the "slave antenna" is to enable reception and transmission to and from a satellite operating in an appropriate frequency band, e.g. X or K-band, with the purpose to communicate information, e.g. data, at a high speed and relative low cost. The satellite tracked by the "slave antenna" is called "slave antenna satellite" for convenience. Since the "slave antenna" typically posses the highest gain it also inherently may present the highest technical challenge in terms of stabilization. The basic concept of the preferred embodiment is to stabilize the "master antenna" utilizing steps (1) and (2) as described below and to stabilize the "slave antenna" utilizing steps (1), (2) and (3) described below:

(1) Step one is to generate a "stabilized platform" stabilized by means of sensors. This "stabilized platform" will carry the physical structure of both "master antenna" and "slave antenna". The "stabilized platform" will to its best compensate for vehicle movements such as roll and pitch but will not compensate for vehicle turn and yaw.

(2) Step two is to utilize a tracking and search performance of a low to medium gain antenna that operates in the L-band. This tracking and search performance may include a beam-squint technology optimised for the actual application. The low to medium gain L-band antenna will be given the role of a "master antenna" in that information derived from its tracking activity in terms of an absolute azimuth angle will be utilized as a reference for the "slave antenna(s)". The tracking and search performance of the "master antenna" is dramatically improved by the fact that it is placed on the "stabilized platform" as described in (1). The result of steps (1) and (2) should be that the "master antenna" is stabilized and steadily tracking the received signals from the "master antenna satellite" (typically a satellite such as an Inmarsat satellite transmitting a constant modulated or un-modulated carrier in the L-band). The "slave antenna" however may not be stabilized solely as a result of actions in step (1) and step (2). Stabilization of the "slave antenna" may require the further action described in (3) below.

(3) Step three is to first utilize the actual azimuth (or heading) angle achieved by the "master antenna" due to its activity in tracking the "master antenna satellite", secondly to feed an offset azimuth angle ALPHA(AZ) based on knowledge of the position of the "master antenna satellite" relative to the "slave antenna satellite" that is going to be tracked by the "slave antenna". Thirdly to feed to the "slave antenna" an elevation angle ALPHA(ELS) i.e. an angle relative to a horizontal plane such as that plane defined by the "stabilized platform". These offset angles will command the "slave antenna" bore sight to an angular position at or very close to the position where the received signal strength from the "slave antenna satellite" is optimum. As an even further mean of optimising the received signal strength from the "slave antenna satellite" a dual axis beam squint technology may be adapted for the "slave antenna".

Initial Setting of "Stabilized Platform" and "Master Antenna"

FIG. 1*a* shows a principle drawing of a preferred embodiment of the present invention. The said "stabilized platform" is a part of the preferred embodiment of the present invention and is shown in principle in FIG. 1*d*. The designation and reference numerals of the various components are given in Table 1.

Figure 1B:
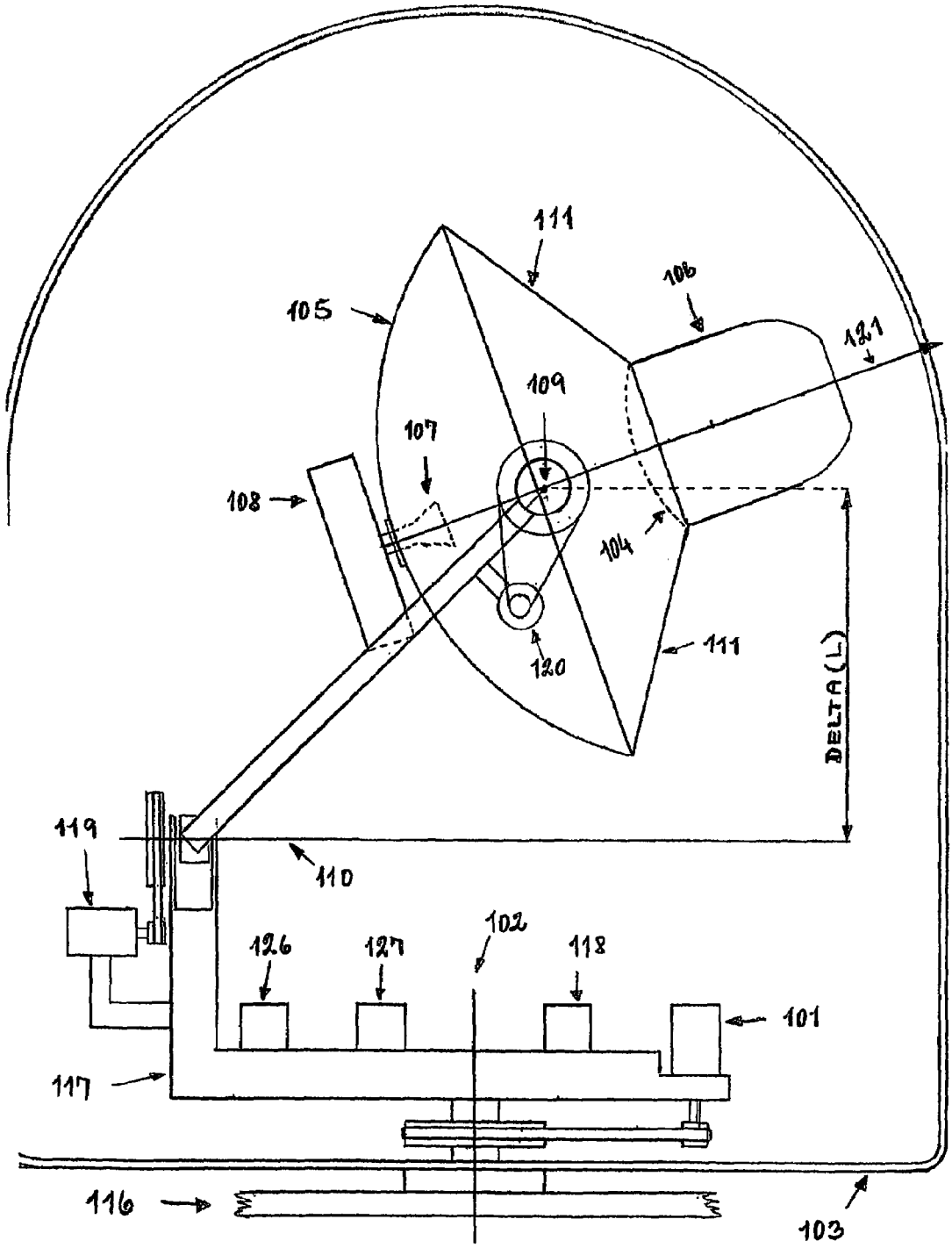
FIG. 1*b* shows a side view of a first embodiment of the present invention.
Figure 1C:
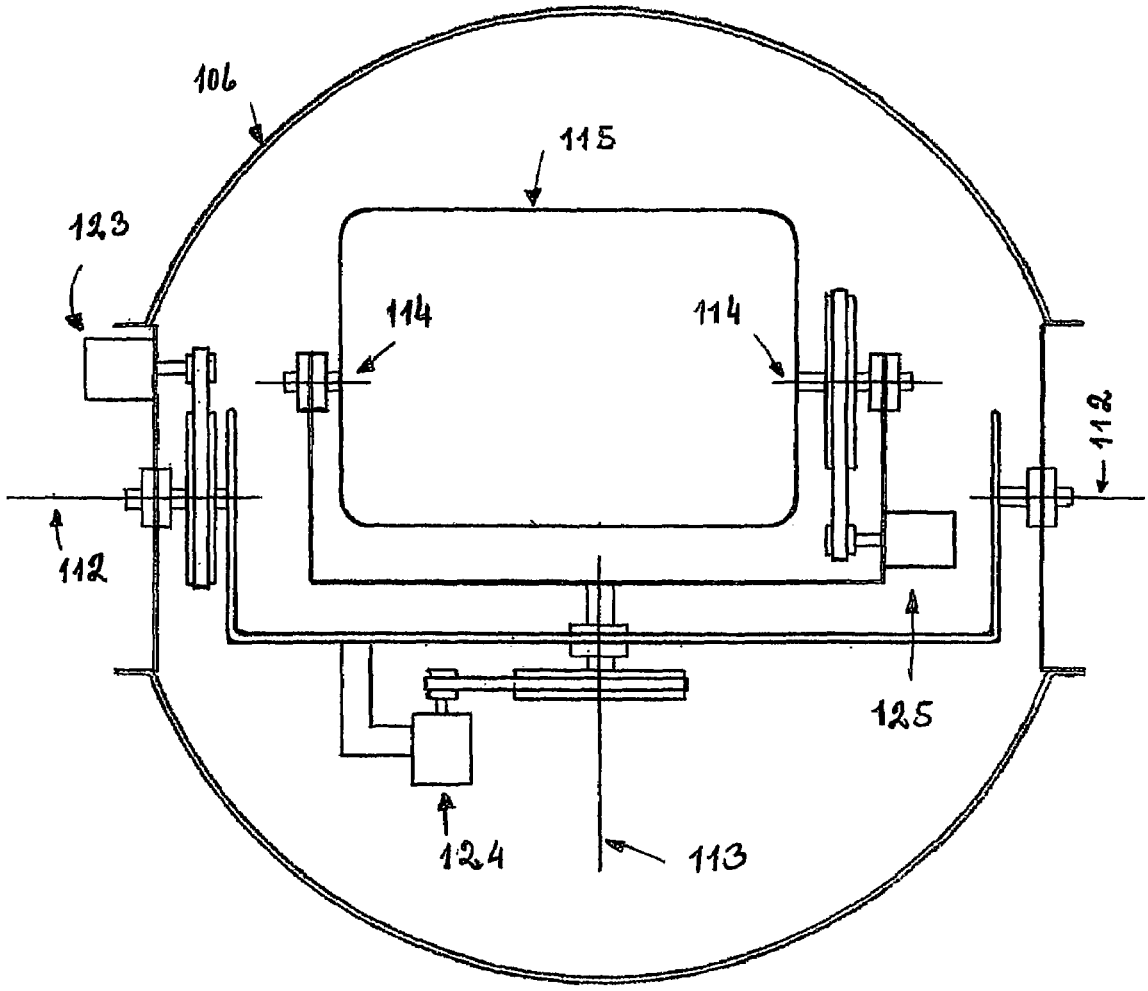
FIG. 1*c* shows a front view of the "master antenna" with a cross section of its dome.
Figure 1D:
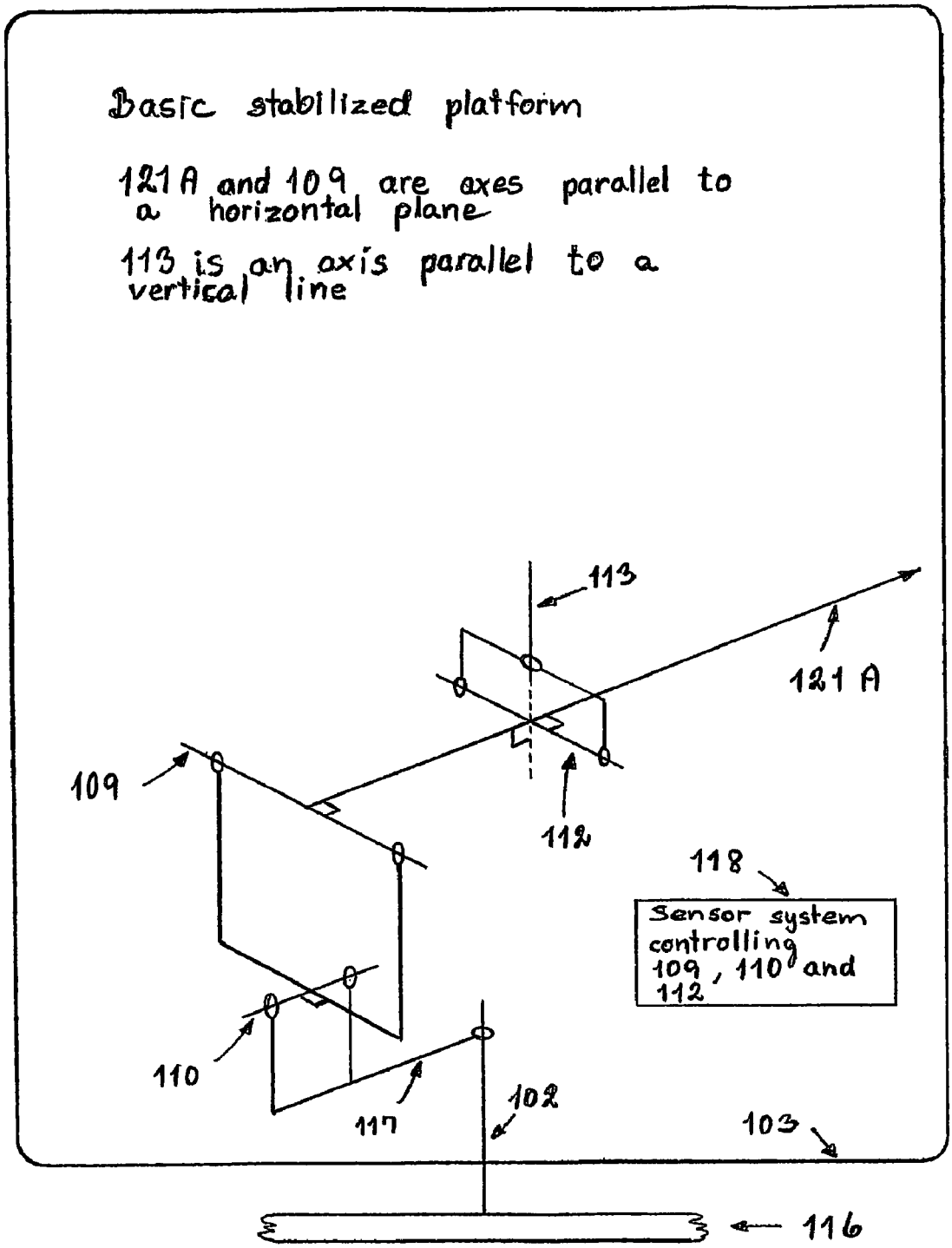
FIG. 1*d* shows the principles of the "stabilized platform" which is a part of a first embodiment of a system according the present invention.

Referring to FIG. 1*b* and FIG. 1*d* the "stabilized platform" comprises a dual axis sensor electronic system 118 that utilizes the direction of the gravity vector to command the "cross elevation motor" 119 to turn the "cross elevation axis" 110 in such a way that the "elevation axis" 109 is kept in a perfect or almost perfect horizontal position even when the vehicle is doing high amplitude roll and pitch movements. Further, the sensor electronic system 118 commands the "elevation motor" 120 to turn the "elevation axis" 109 in such a way that "physical bore-sight for slave antenna" 121 is kept in a perfect or almost perfect horizontal position, which position is called 121A in FIG. 1*d*. The position 121A will be maintained even when the vessel is performing high amplitude roll and pitch movements. Further, the sensor electronic system 118 commands the "motor for counter elevation axis for master antenna" 123 (refer to FIG. 1*c*) to turn the "counter elevation axis" 112 so that "azimuth 11 axis" 113 is kept in a perfect vertical or almost perfect vertical position even when the vessel is performing high amplitude roll and pitch movements.

The above mentioned settings of the axes 110, 109 and 112 with the result that the "physical bore sight axis for slave antenna" 121 is kept in a perfect or almost perfect horizontal position and axis 113 is kept in a perfect or almost perfect vertical position is called the "initial setting" of the "stabilized platform". The position (turning) of the "azimuth I axis" 102 may be arbitrary during the process of "initial setting".

In a preferred embodiment of the present invention beam squint technology is utilized for positioning (stabilizing) of the azimuth direction of the "master antenna", which has already been stabilized in the sense that its "azimuth II axis" 113 is kept in a perfect or almost perfect vertical position by the "stabilized platform". The beam-squint technology, such as described in U.S. Pat. No. 6,281,839 and which is hereby included by reference, is optimised for the actual application. This optimisation implies (but is not limited to) selecting of optimum beam squint rate and selecting optimum filtering in a detector circuitry.

In addition to the aforesaid "initial setting" of the "stabilized platform" there will be an "initial setting" of the "physical bore-sight axis of the master antenna" 122 in that the beam squint circuitry including motor drivers for motors 124 and 123 will command motors 124 and 123 to a position where the "physical bore-sight axis for master antenna" 122 is parallel to the "physical bore sight axis for the slave antenna" when this is in the "initial setting" 121A. The complete "initial setting" is illustrated in FIG. 1*e* where the "initial setting" of the "physical bore-sight axis for master antenna" is called 122A for reference.

Figure 1E:
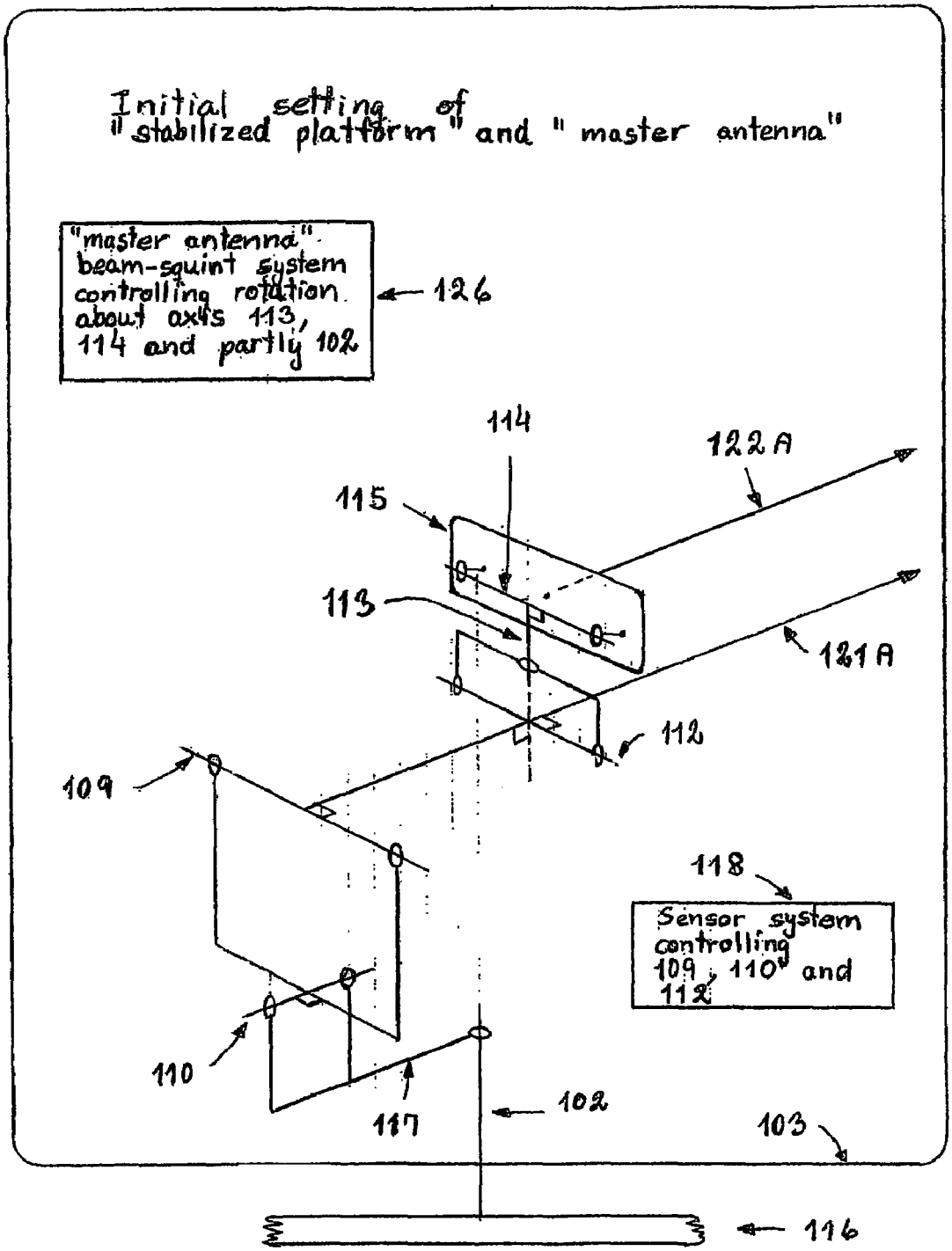
FIG. 1*e* shows the principles "initial setting" of the "stabilized platform" and "master antenna"
Figure 1F:
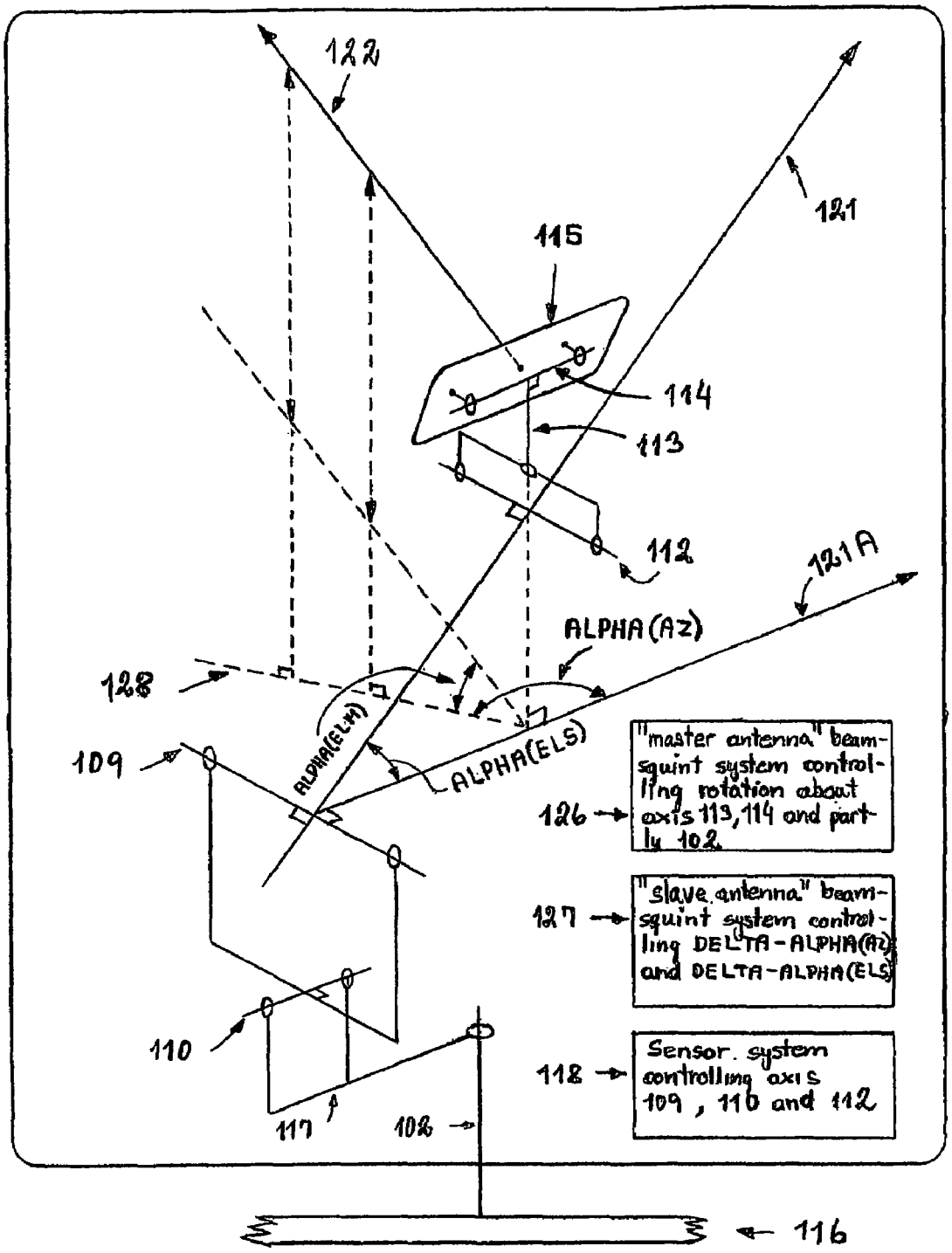
FIG. 1*f* shows a situation of actual operation of the complete tracking system.

The following explanation will be with reference to FIG. 1*f*. It should be understood that the elevation of the "physical bore-sight axis for slave antenna" 121 can be changed from its initial setting 121A to any value by defining an elevation angle ALPHA(ELS) for the "slave antenna" and let the sensor system 118 command the motor 120 to turn "elevation I axis" 109 to the new defined elevation direction. The sensor system 118 should not lose information about the direction of the "physical bore-sight axis for slave antenna" when this is in the "initial setting" 121A by performing this action. Also it should be understood that any action in terms of a turn of the axis 109 should be counteracted by the control of the sensor system 118 of the axis 112 so that in any case axis 113 should be in a vertical position. Further it should be understood that the direction of "physical bore sight for master antenna" 122 can be changed in elevation from its initial setting 122A simply by defining an elevation angle ALPHA(ELM) as shown in FIG. 1*f*. The control system 126 should not lose information about the direction of the "initial setting" of the "physical bore-sight axis for master antenna" 122A. In the preferred embodiment the values of ALPHA(ELS) and ALPHA(ELM) may be between 0 and 90 degrees. As can be seen by comparison of FIG. 1*e* and FIG. 1*f*, the angle ALPHA (AZ) is the difference in horizontal direction between the "physical bore-sight axis of master antenna" 122 and the "physical bore-sight axis of slave antenna" 121. Further, from this comparison it can be seen that the "initial setting" of the "stabilized platform" and the "master antenna" can be characterized by ALPHA(AZ), ALPHA(ELM) and ALPHA (ELS) all being equal to zero.

Search and Tracking Functionality of "Master Antenna" and "Slave Antenna"

Upon completion of the "initial setting" of the "master antenna" and "slave antenna" as shown in FIG. 1*e* the "master antenna" and subsequently the "slave antenna" is prepared for performing a "master antenna search routine" and "slave antenna search routine", respectively, whereby a satellite characterized by transmitting a constant carrier signal modulate or un-modulated at a known frequency will be searched and after acquiring "satellite lock" will maintain track of the satellite. The "master antenna search routine" will be as follow with reference to FIG. 1*f*:

(a1). ALPHA(ELM) will be commanded to some appropriate value equal to approximately half the 3 dB beam width of the elevation pattern of master antenna 115.

(b1). The master antenna beam-squint system 126 will command "azimuth I motor" 101 to turn and let master antenna 115 search for a signal from the "master antenna satellite". Notice that the "slave antenna" is also performing a turn (not search) in this case since ALPHA(AZ) is still zero.

(c1). If after a full turn no signal was found, ALPHA(ELM) will be commanded to increase by a value equal to approximately the 3 dB elevation beam-width of the master antenna 115 and (b1) will be repeated.

(d1). If a signal from the "master antenna satellite" is detected, the turning about "azimuth I axis" 102 will stop, and the "elevation II axis" for the "master antenna" 114 will be commanded to optimise the value of ALPHA(ELM), so that maximum signal strength will be received from the "master antenna satellite". If a signal from the "master antenna satellite" has not been detected, then (c1) will be repeated and the process will continue until ALPHA(ELM) is more than 90 degrees less half the 3-dB elevation beam width of the master antenna 115. In this way a full scan of the hemisphere has been conducted; normally a signal will be detected by the "master antenna" beam-squint system 126 before the completion of this process. If no signal is found, then information will be given by system 126 in which case it can be up to the operator to decide upon the further steps, or a new searching at a different "master antenna satellite" frequency may be initiated automatically.

After the performance of a search, the "master antenna" will have acquired "satellite lock" and systems 126 and 118 will ensure that an accurate pointing of the "physical boresight axis for the master antenna" 122 is maintained, and a two way or only one way communication link via the "master antenna satellite" has been established. If a two way or one way communication link via a "slave antenna satellite" is going to be established the following procedure can be followed:

(a2). The orbital position of the "slave antenna satellite" must be known accurately or at least within ±15 degrees of orbital arc. The orbital position of the "master antenna satellite" must be known and so must the actual geographical position of the "mobile terminal". Based on this information two angles can be calculated or found from a look up table namely ALPHA(AZ) and ALPHA(ELS) as defined in FIG. 1*f*.

(b2). ALPHA(ELS) will be set by the system 118 in the way that it will command "elevation I motor" 120 to turn the axis 109 to the correct value ALPHA(ELS); notice that at any time the "counter elevation axis" for "master antenna" 112 will be turned in opposite direction by the same angular arc so that axis 113 is kept in a vertical position at any time.

(c2). The value ALPHA(AZ) is set by rotating axis 102 to the amount ALPHA(AZ)/2 and simultaneously rotating but in opposite direction the axis 113 to the amount ALPHA(AZ)/2. In FIG. 1*f* this turning of two axis will result in an angular difference between lines 128 and 121A equal to ALPHA (AZ). Notice that at any time the direction of pointing of axis 122 into space will not be changed i.e. the tracking performance of the "master antenna" will not be disturbed.

(d2). The frequency of the modulated or un-modulated carrier that is going to be tracked by the "slave antenna" is entered into system 127. If a signal is detected by the receive system contained in 127, the controlling of axes 109 and 102 will still be by means of system 118 but also by means of system 127 in the sense that system 127 can generate two angle values called DELTA-ALPHA(AZ) and DELTA-ALPHA(ELS) to be superimposed to the values for ALPHA(AZ) and ALPHA(ELS), respectively. The result is that the direction of axis 121 will be such that a maximum signal level is received by the "slave antenna", and that tracking of the "slave antenna satellite" has been established. As vehicle moves over the surface of the earth, the values of ALPHA (AZ) and ALPHA(ELS) may change.

Further Characteristics of the Preferred Embodiment

The following explanation is with reference to FIG. 1*b* and FIG. 1*c*. The "stabilized platform" in a preferred embodiment of the invention may further comprise means to physically support the "master antenna" enclosed in a dome 106, which will preferably be a part of the supporting structure as well as offering physical protection of the "master antenna". The "master antenna" can be turned about three axes, namely a so-called "counter elevation axis" 112, an "azimuth II axis" 113 and an "elevation II axis" 114. The counter elevation axis 112 is preferably arranged so that it is parallel to the "elevation I axis" 109, i.e. axis 112 is kept in a perfect or almost perfect horizontal position by means of the dual axis sensor system 118. Furthermore, the electronics in 118 may perform a tight coupling between axes 109 and 112 in that when ALPHA(ELS) is set to a value between 0 and 90 degree, axis 112 is rotated exactly −ALPHA(ELS) degrees so that the "azimuth II axis" 113 for the "master antenna" is always kept in a perfect or almost perfect vertical position.

In order to generate the above mentioned command signals to "cross elevation motor" 119 and "elevation I motor" 120 and "motor for counter elevation axis" 123, the dual axis sensor system 118 preferably is mounted on the "stabilized platform" as shown in FIG. 1*b* in such a way that sensing of the gravity vector is done by projecting the vector onto two planes, one plane at a right angle to axis 110 and one plane at a right angle to axis 109. The sensor electronics will measure direction of these two components and compensate for tangential accelerations that occur when e.g. the EME is mounted high up on e.g. a mast on the vehicle. This arrangement of the sensor system 118 will allow for closed loop operation of the control of motors 119, 120 and hence motor 123. It is however no deviation from the basic principles of this invention to keep the sensor electronics 118 at a place e.g. in a fixed position relative to the dome 103 and utilize open loop control of the three motors 119, 120 and 123.

Further About the Mechanical Structure of the Preferred Embodiment of the Present Invention In a preferred embodiment of the present invention as shown in FIG. 1*b* there is a distance DELTA(L) between "cross-elevation axis" 110 and "elevation I axis" 109, and in conventional designs DELTA(L) is kept at or close to 0. The purpose of having DELTA(L) different from 0 is to create space for the typically rather bulky "front-end for slave antenna" 108 and its feed system 107 and to keep distance between the front-end 108 and the feed system 107 as small as possible with the result that feeder loss is kept at a minimum, whereby required transmit power is kept at a minimum. The draw back is that a considerable amount of imbalance is created for the "cross-elevation axis" 110. It is a part of this invention that the mechanical design may be such that the drawbacks of the DELTA(L) being different from zero are nullified or considerably reduced.

It should be noticed that the mechanical arrangement of the "master antenna" enclosed in the dome 106 and shown in detail in FIG. 1*c* is not the only possible. The embodiment of the "master antenna" in the present invention has three axes namely 112, 113 and 114. Another possible axis arrangement will consist of only two axes, one parallel to "physical boresight for slave antenna" 121 plus one axis at a right angle to this and parallel to the antenna element 115. This arrangement shall be considered as being within the scope of this invention but its drawback will be that it cannot to the same extent benefit from the advantages of the beam-squint technology of the "master antenna" and its ability to generate a stable azimuth reference.

While in the above discussion, the invention has been described with reference to particular embodiments, it should be understood that it is also within the scope of the present invention to cover embodiments as described in the following:

A mobile satellite antenna system for use in a vehicle and preferably a vessel or ship, comprising: a hybrid antenna system or antenna assembly consisting of a plurality of antenna elements, one of which is a "master antenna" and the other being one or more "slave antenna(s)" and further comprising a mechanical arrangement that is characterized as a "stabilized platform", said "stabilized platform" being part of the electromechanical arrangement for stabilizing the "master antenna" and "slave antenna(s)" in order to be able to simultaneously receive and transmit radio signals via the "master antenna" and "slave antenna(s)", even when the vessel is exposed to a combination of motions such as roll, pitch, yaw and turn. Here, the "stabilized platform" may be a "first means" to achieve stabilization of both "master antenna" and "slave antenna(s)" in that it may compensate for ships roll and pitch movements.

The "master antenna" may preferably be build onto the "stabilized platform" and hence exposed to no or very little roll and pitch of the vessel, and the "master antenna" may utilize antenna beam squint technology designed to generate a very accurate further stabilization of the master antenna and subsequently the "slave antenna(s)" by generating an accurate azimuth reference angle and compensate for vessels yaw and turn. Here, the "master antenna" beam squint technology may be a "second means" (which may be supplementary to "first means") to achieve stabilization of the "master antenna" and the "slave antenna(s)".

The "slave antenna" or plurality of "slave antennas" may preferably be build onto the "stabilized platform" and hence exposed to no or very little roll and pitch of the vessel and may further utilize the accurate azimuth reference angle information from the "master antenna" and hence may be exposed to no or very little yaw and turn of the vessel and preferably may be utilizing dual axis antenna beam squint technology to achieve the final accurate stabilization of the "slave antenna (s)". Here, the beam squint technology may be a "third means" (supplementary to said "first means" and said "second means") to stabilize the "slave antenna(s)".

The present invention also covers a mobile satellite antenna system for use in a vehicle, comprising: a hybrid antenna system or antenna assembly consisting of a plurality of antenna elements, one of which is a "master antenna" and one or more "slave antenna(s)". The "master antenna" is mounted on a "stabilized platform", which in turn is mounted on a "moving platform", and designed to track a suitable geostationary satellite signal preferably in or around the L-band or S-band and preferably utilizing beam squint technology and in doing so will enable L-band or S-band communication in a forward and return direction and be generating a reference in terms of azimuth direction of its physical antenna bore sight axis. Here, the reference in azimuth may be utilized in stabilization of the azimuth direction of the "slave antenna(s) ", where the slave antenna(s) may be designed to track on a satellite be it geo-stationary or low or medium orbit satellites at any position in the hemisphere or in some cases only part of the hemisphere. At least one of the "slave antenna" may in a preferred embodiment of the present invention be designed to have high gain in order to enable high-speed data forward and return link communication. The stabilized platform may be kept ideal or almost ideal parallel to the horizontal surface of the earth independent of the movements such as roll or pitch of the "moving platform" to which the "stabilized platform" is attached. The "moving platform" may be a fixed part of the vehicle body.

According to an embodiment of the mobile satellite antenna system of the present invention both master and slave antennas may be mounted on the same stabilized platform, which may be kept ideal or almost ideal parallel to the horizontal surface of the earth. This stabilized platform may constitute a reference in terms of an elevation angle, which may be utilized for the stabilization for the master antenna and the slaves. Further the slave antennas may or may not utilize advanced and optimised beam squint technology for a more accurate and efficient fine stabilization.

It should be understood that for a preferred embodiment of the mobile satellite antenna system according to the present invention no information from external devices such as ships gyrocompass is required. Furthermore, the physical interface to the antenna system may preferably be very simple and consist of only one coaxial cable in order to make physical installation of the system on a vehicle relative simple and low cost.

By a suitable design of an embodiment of the mobile satellite antenna system of the present invention for use on a vehicle, in particular a ship, such design may enable operation of the system even if the ship is moving in rough sea with roll motions up to ±25 degrees or more and simultaneous pitch motion up to ±25 degrees or more and simultaneously yaw and turn motion with up to 20 degrees per second or more without loosing track of any of the satellites being tracked by the master and slave antennas.

For an embodiment of the mobile satellite antenna system of the invention, the mechanical design of the "stabilized platform" may be such that it will enable a complete microwave front end consisting of HPA, LNA and feed-system to be placed at an optimum position relative to the slave antenna phase-centre in order to minimize feeder-loss for the slave antenna receive- and transmit signals and in order to improve isolation between these signals. The mechanical design of the "stabilized platform" may also be such that a considerable amount of imbalance about the main azimuth axis and cross-elevation axis can be accepted even during vehicles vibration, and the mechanical design may comprise isolation of the vibration in the mechanical structure, where the isolation may enable or enhance the imbalance concept and further enable or enhance the mechanical design of the master antenna to be very simple, light weight and low cost.

While the invention has been particularly shown and described with reference to particular embodiments, it will be understood by those skilled in the art that various changes in form and details may be made therein without departing from the spirit and scope of the invention, and it is intended that such changes come within the scope of the following claims.

This invention claimed is:

1. An antenna assembly for satellite tracking, said antenna assembly comprising:

a master antenna for receiving and transmitting first satellite signals to and from a master antenna satellite in a first frequency band, a slave antenna for receiving second satellite signals from a slave antenna satellite in a second satellite band, said master and slave antennas being mounted on the same stabilizing platform, a master drive assembly for mechanically changing the direction of a physical bore-sight axis of the master antenna, and a slave drive assembly for mechanically changing the direction of a physical bore-sight axis of the slave antenna, wherein said master and slave assemblies are adapted for arranging the physical bore-sight axes of the master antenna and the slave antenna at different directions in relation to each other in response to one or more master-slave control signals, wherein the antenna assembly further comprises control means for providing one or more master-slave control signals to the slave drive assembly to thereby control the arrangement of the direction of the physical bore-sight axis of the slave antenna in relation to the physical bore-sight axis of the master antenna so that the angular distance in azimuth between said physical bore-sight axes is set at a given azimuth value, ALPHA(AZ), and wherein the control means for providing the one or more master-slave controls signals to the slave drive assembly is further adapted for providing control signals to thereby control the arrangement of the direction of the physical bore-sight axis of the slave antenna so that the angular distance in elevation between the physical bore-sight axis of the slave antenna and the horizontal plane is set at a given elevation value, ALPHA(ELS).

2. An antenna assembly according to claim 1, wherein the master antenna is mounted on the slave antenna with the slave antenna being mounted to the stabilizing platform.

3. An antenna assembly according to claim 1, wherein the slave antenna is further adapted for transmitting second satellite signals to the slave antenna satellite in the second satellite band.

4. An antenna assembly according to claim 1, wherein the master antenna is movably secured to the master drive assembly, and the slave antenna is movably secured to the slave drive assembly.

5. An antenna assembly according to claim 1, wherein the master drive assembly is rigidly fixed in relation to the slave antenna.

6. An antenna assembly according to claim 5, further comprising one or more control systems being adapted for providing control signals to the master and slave dive assemblies in order to lock the physical bore-sight axes of the master antenna and the slave antenna in the same vertical plane, whereby when mechanically moving the master antenna to change the direction in azimuth of the physical bore-sight axis of the master antenna, the direction of the physical bore-sight axis of the slave antenna is mechanically changed to the same degree in azimuth.

7. An antenna assembly according to claim 1, further comprising master antenna switching means for changing or switching a direction of reception of the master antenna.

8. An antenna assembly according to claim 7, wherein the master antenna switching means is adapted for performing a mechanically changing or switching of the direction of the physical bore-sight axis of the master antenna followed by an electrically changing or switching of the direction of reception of the master antenna.

9. An antenna assembly according to claim 8, wherein the master antenna is an array antenna.

10. An antenna assembly according to claim 9, wherein the master antenna switching means is adapted for performing the electrically changing or switching of the direction of reception of the master antenna by use of beam switching or beam squint technology.

11. An antenna assembly according to claim 7, further comprising monitor means for monitoring, during the changing or switching of direction of reception of the master antenna, one or more signals carrying information representing variations in receiving signal strength of one or more signals transmitted from the master antenna satellite.

12. An antenna assembly according to claim 11, further comprising control means for providing one or more master control signals to the master drive assembly and/or the slave drive assembly to thereby control the movement of the master antenna in response to the results of the monitoring of the signal strength information signal(s) corresponding to the signal(s) from the master antenna satellite, thereby changing the direction of the physical bore-sight axis of the master antenna so as to reduce pointing errors of the master antenna in relation to the master antenna satellite.

13. An antenna assembly according to claim 1, further comprising slave antenna switching means for changing or switching a direction of reception of the slave antenna.

14. An antenna assembly according to claim 13, wherein the slave antenna switching means is adapted for performing a mechanically changing or switching of the direction of the physical bore-sight axis of the slave antenna.

15. An antenna assembly according to claim 13, further comprising monitor means for monitoring, during the changing or switching of direction of reception of the slave antenna, one or more signals carrying information representing variations in receiving signal strength of one or more signals transmitted from the slave antenna satellite.

16. An antenna assembly according to claim 15, further comprising control means for providing one or more slave control signals to the slave drive assembly and/or the master drive assembly to thereby control the movement of the slave antenna in response to the results of the monitoring of the signal strength information signal(s) corresponding to the signal(s) from the slave antenna satellite, thereby changing the direction of the physical bore-sight axis of the slave antenna so as to reduce pointing errors of the slave antenna in relation to the slave antenna satellite.

17. An antenna assembly according to claim 1, wherein the slave antenna comprises a main reflector for reflecting said slave antenna satellite signals and a feed unit for receiving the reflected slave antenna satellite signals, said slave antenna being of the Cassegrain type having a sub-reflector arranged substantially inside the focus of the main reflector and having the feed unit arranged substantially at the surface of the main reflector, and wherein the master drive assembly is arranged at least partly at a blind spot of the slave antenna in front of the sub-reflector.

18. A method for satellite tracking by use of an antenna assembly having a master antenna for receiving and transmitting first satellite signals to and from a master antenna satellite in a first frequency band, and a slave antenna for receiving second satellite signals from a slave antenna satellite in a second frequency band, said master and slave antennas being mounted on the same stabilizing platform and having physical bore-sight axes which can be arranged at different directions in relation to each other, said method including:

a) a master antenna search routine comprising the steps of:

changing or switching a direction of reception of the master antenna, monitoring, during the changing or switching of direction of reception of the master antenna, one or more signals carrying information representing variations in receiving signal strength of one or more signals transmitted from the master antenna satellite, and mechanically moving the master antenna in response to the results of the monitoring of the signal strength information signal(s) corresponding to the signal(s) from the master antenna satellite, thereby obtaining a direction of the physical bore-sight axis of the master antenna resulting in reduced pointing errors of the master antenna in relation to the master antenna satellite; and b) a slave antenna search routine comprising the steps of:

arranging the direction of the physical bore-sight axis of the slave antenna at a first slave direction, wherein the arrangement of the direction of the physical bore-sight axis of the slave antenna at the first slave direction comprises arranging the angular distance in azimuth between the physical bore-sight axes of the master antenna and the slave antenna at a given azimuth value, and wherein the arrangement of the direction of the physical bore-sight axis of the slave antenna at the first slave direction further comprises arranging the angular distance in elevation between the physical bore-sight axis of the slave antenna and the horizontal plane at a given elevation value, ALPHA(ELS), said given azimuth value and said given elevation value being determined from the obtained direction of the physical bore-sight axis of the master antenna, the orbital position of the master antenna satellite, the orbital position of the slave antenna satellite, and the geographical position of the antenna assembly.

19. A method according to claim 18, wherein the master antenna is mounted on the slave antenna with the slave antenna being mounted to the stabilizing platform.

20. A method according to claim 18, wherein after the arrangement of the physical bore-sight axis of the slave antenna at the first slave direction, the slave antenna search routine further comprises:

changing or switching a direction of reception of the slave antenna, monitoring, during the changing or switching of direction of reception of the slave antenna, one or more signals carrying information representing variations in receiving signal strength of one or more signals transmitted from the slave antenna satellite, and mechanically moving the slave antenna in response to the results of the monitoring of the signal strength information signal(s) corresponding to the signal(s) from the slave antenna satellite, thereby changing the direction of a physical bore-sight axis of the slave antenna so as to reduce pointing errors of the slave antenna in relation to the slave antenna satellite.

21. A method according to claim 18, said method further including an initial setting routine being performed before the master antenna search routine, said initial setting routine comprising:

locking the physical bore-sight axes of the master antenna and the slave antenna in the same vertical plane, whereby when mechanically moving the master antenna to change the direction in azimuth of the physical bore-sight axis of the master antenna, the direction of the physical bore-sight axis of the slave antenna is mechanically changed to the same degree in azimuth, said locking being maintained during the master search routine.

22. A method according to claim 21, wherein the initial setting routine comprises arranging and maintaining the physical bore-sight axis of the slave antenna at a substantially horizontal position.

23. A method according to claim 22, wherein the initial setting routine further comprises arranging and maintaining the physical bore-sight axis of the master antenna at a substantially horizontal position.

24. A method according to claim 18, wherein the changing or switching of the direction of reception of the master antenna in the master antenna search routine comprises a mechanically changing or switching of the direction of the physical bore-sight axis of the master antenna followed by an electrically changing or switching of the direction of reception of the master antenna.

25. A method according to claim 24, wherein the electrically changing or switching of the direction of reception of the master antenna is initiated when one or more signals transmitted from the master antenna satellite are received by a given signal strength.

* * * * *